US006717140B2

(12) United States Patent
Evrard

(10) Patent No.: US 6,717,140 B2
(45) Date of Patent: Apr. 6, 2004

(54) SELECTIVE ION SOURCE FOR HIGH INTENSITY FOCUSED AND COLLIMATED ION BEAMS—COUPLING WITH HIGH RESOLUTION CYCLOIDAL PATH SECTOR

(76) Inventor: Robert Evrard, 5 rue Carnot, 95690 Nesles la Vallee (FR)

( * ) Notice: Subject to any disclaimer, the term of this patent is extended or adjusted under 35 U.S.C. 154(b) by 0 days.

(21) Appl. No.: 10/273,729

(22) Filed: Oct. 18, 2002

(65) Prior Publication Data

US 2003/0094570 A1 May 22, 2003

(30) Foreign Application Priority Data

Oct. 19, 2001 (FR) ..... 01 13488

(51) Int. Cl.[7] ..... H01J 49/00
(52) U.S. Cl. ..... 250/296; 250/294
(58) Field of Search ..... 250/296, 297, 250/298, 294, 293, 290, 281, 282

(56) References Cited

U.S. PATENT DOCUMENTS 5,304,799 A * 4/1994 Kurzweg ..... 250/296

FOREIGN PATENT DOCUMENTS

| | | |
|---|---|---|
| FR | 2 610 138 A | 7/1988 |
| FR | 2 737 606 A | 2/1997 |
| FR | 2 811 806 A | 1/2002 |

* cited by examiner

*Primary Examiner*—Kiet T. Nguyen

(74) *Attorney, Agent, or Firm*—Rosenthal & Osha L.L.P.

(57) ABSTRACT

A mass spectrometer is described in which the ions are submitted to the action of a uniform adjustable electrical field $\vec{E}_1$, within a set of plane parallel electrodes $a_1, \ldots, a_i, \ldots a_n$ fitted with properly located slits for the ions transmission, and to the action of a uniform magnetic induction $\vec{B}_1$. A reference system x,y is considered in a plane perpendicular to $\vec{B}_1$, the axis x and y being respectively perpendicular and parallel to $\vec{E}_1$, and the origin of the reference system being fixed at an average starting point of the ions. The crossed fields $\vec{E}_1, \vec{B}_1$, act together in an area where y<d and the magnetic induction $\vec{B}_1$ acts alone in a further area where y>d, d being a distance separating the average starting point of the ions from the electrode $\alpha_n$. The selection slit $S_1$ is located at coordinates x=2,1d and y=2d, and the value of $E_1$ that is applied for the selection of the ions having the number of mass n is defined by $$E_1 = \frac{2d}{n}\frac{e}{m}B_1^2, \quad \text{with} \quad \frac{e}{m}$$

corresponding to a ratio charge/mass for $H^+$. The ions are created by electronic bombardment only in the vicinity of a plane parallel to $\vec{B}_1$, making an angle of 45° with $\vec{E}_1$, and a heated filament F for emitting electrons being stretched above the electrodes $a_1, a_2$, such that a resulting selected ion beam is parallel to the x axis when crossing $S_1$. The ion beam may feed, under optimal conditions, a "cycloid path" mass spectrometer or a 90° magnetic sector. The system provides improved sensitivity and a high resolution within a small and very simple instrument.

6 Claims, 2 Drawing Sheets

SELECTIVE ION SOURCE FOR HIGH INTENSITY FOCUSED AND COLLIMATED ION BEAMS— COUPLING WITH HIGH RESOLUTION CYCLOIDAL PATH SECTOR

CROSS REFERENCE TO RELATED APPLICATIONS

This application claims priority from French Patent Application Serial No. FR0113488 filed on Oct. 19, 2001.

BACKGROUND OF THE INVENTION

Ions sources known from prior art, as described for example in the publication "Electron Optics" by Pierre Grivet, 2$^{nd}$ Edition, Pergamon Press Reprint, December 1971 are subject to a number of limitations.

In order to minimize the energy dispersion of ions generated in the ions source, the ionisation space is reduced.

As a result, ionisation cells may be nearly closed and the ions extraction has a rather poor yield.

In case that it is required to improve the collimating, this may be achieved by a selection through a number of narrow slits.

However introducing selection and reducing the ionisation space may drastically reduce the sensitivity to a value in the order of $10^{-4}$ A/Torr or less, with the exception of very big instruments.

The applicant has earlier described a high intensity selective ion source in a French patent application Nr 0009081 filed Jul. 17, 2000, in which ions created by electronic bombardment in a large volume and having the same number of mass n, can be focused on a narrow slit $S_1$ in order to obtain an emerging ion beam. In addition, U.S. application Ser. No. 09/518,507, entitled "System for Ionization and Selective Detection in Mass Spectrometers," was filed by the inventor of the present invention on Mar. 3, 2000. This application is hereby incorporated by reference and is referred to herein as "the Evrard '507 application."

SUMMARY OF THE INVENTION

In a first aspect the invention provides a mass spectrometer in which the ions are submitted to the action of a uniform adjustable electrical field $\vec{E}_1$, within a set of plane parallel electrodes $a_1, \ldots, a_i, \ldots a_n$ fitted with properly located slits for the ions transmission, and to the action of a uniform magnetic induction $\vec{B}_1$. A reference system x,y is considered in a plane perpendicular to $\vec{B}_1$, the axis x and y being respectively perpendicular and parallel to $\vec{E}_1$, and the origin of the reference system being fixed at an average starting point of the ions. The crossed fields $\vec{E}_1, \vec{B}_1$, act together in an area where y<d and the magnetic induction $\vec{B}_1$ acts alone in a further area where y>d, d being a distance separating the average starting point of the ions from the electrode $a_n$. The selection slit $S_1$ is located at coordinates x=2.1d and y=2d, and the value of $E_1$ that is applied for the selection of the ions having the number of mass n is defined by $$E_1 = \frac{2d}{n}\frac{e}{m}B_1^2, \text{ with } \frac{e}{m}$$

corresponding to a ratio charge/mass for $H^+$. The ions are created by electronic bombardment only in the vicinity of a plane parallel to $\vec{B}_1$, making an angle of 45° with $\vec{E}_1$, and a heated filament F for emitting electrons is stretched above the electrodes $a_1, a_2$, along a line where x=y, the electron beam being limited by a flat rectangular diaphragm parallel to F and located between F and the electrodes $a_1, a_2$, such that a resulting selected ion beam is parallel to the x axis when crossing $S_1$.

In a preferred embodiment of the invention, the ions are submitted to a second couple of crossed fields $\vec{E}_2, \vec{B}_1$, at the exit $S_1$, $\vec{E}_2$ being created within a second set of plane parallel electrodes $b_1, \ldots, b_i, \ldots b_n$, also fitted with properly located slits for the ions transmission. A value of the electric field $E_2$ is equal to $E_1$ cos 45° and a direction of the electric field $E_2$ makes an angle of 45° with $E_1$. A second selection slit $S_2$ is located on the cycloid path on the electrode $b_n$ at a point defined by coordinates X≅8.9d and Y=0 in a further reference system that is defined by axis X and Y, wherein the X axis and the Y axis are respectively perpendicular and parallel to $E_2$. An origin of the further reference system is fixed at $S_1$.

BRIEF DESCRIPTION OF THE FIGURES

The invention will now be described in greater detail with reference to the accompanying drawings, in which FIG. 1 contains an illustration of an embodiment of a mass spectrometer in accordance with the invention, FIG. 2 contains an illustration of an embodiment of a mass spectrometer in accordance with the invention, FIG. 3 contains an illustration of an embodiment of a mass spectrometer in accordance with the invention.

EXAMPLES OF PREFERRED EMBODIMENTS

We will now describe examples of systems that bring important improvements to the systems known from prior art. One advantage of the described examples is that they allow the emerging ion beam to be well collimated. The collimated emerging ion beam provides a powerful ion source that can then feed, in optimal conditions, a "cycloid path" mass spectrometer or a 90° magnetic sector fitted with a very narrow gap.

Figure 1:
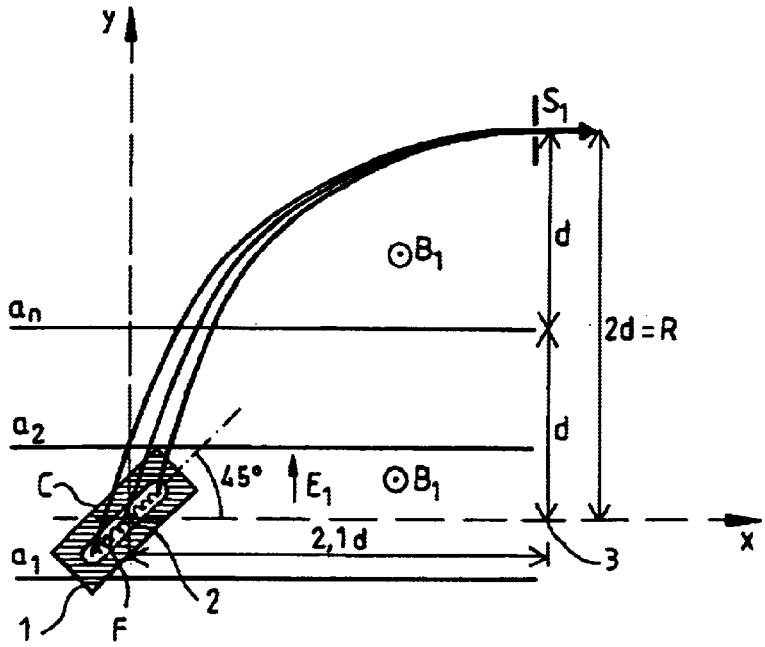

Referring to FIG. 1, ions created by electronic bombardment in an ions source 1 are submitted to the action of a uniform adjustable electrical field $\vec{E}_1$, between a set of plane parallel electrodes $a_1, a_2, \ldots, a_n$ fitted with properly located slits for the transmission of the ions.

The ions are also submitted to the action of a fixed uniform magnetic induction $\vec{B}_1$, that is perpendicular to $\vec{E}_1$, created by an external magnetic circuit sandwiching a box of the instrument (not shown in FIG. 1).

We will use a reference system defined by two axis x,y in a plane perpendicular to $\vec{B}_1$, the axis x and y being respectively perpendicular and parallel to $\vec{E}_1$, and an origin of the reference system being fixed at a determined average starting point 2 of the ions source 1.

The electrical field $\vec{E}_1$ and the magnetic induction $\vec{B}_1$ act in a first area where the value of y verifies $$y<d$$

d being a distance separating the determined average starting point 2 from the electrode $a_n$.

The magnetic induction $\vec{B}_1$ acts alone in a second area where the value of y verifies $$y>d.$$

The ions follow a cycloid path in the first area (y<d) and a circular path with a radius of curvature R in the second area (y>d).

For the ions having a number of mass n and for $$\vec{E}_1 = \frac{2d\omega B}{n} \quad \text{(in which } \omega = \frac{e}{m}B, \text{ with } \frac{e}{m}$$

being the ratio of charge to mass for the hydrogen ion $H^+$), being the ratio of charge to mass for the hydrogen ion $H^+$), the radius of curvature R is:

$$R=2d$$

The centre of curvature 3 having coordinates $(x_0,y_0)$ in the reference system is located at a point defined as follows:

$$x_0=2,1d=1,05R, \text{ and}$$

$$y_0=0.$$

A selection slit $S_1$, is located at a point having following coordinates:

$$x=2.1d=1,05R, \text{ and}$$

$$y=2d=R.$$

For the proper determined value of $\vec{E}_1$, the ions n cross the selection slit $S_1$, the trajectories of the ions being at this point parallel to the x axis.

Let us consider now the case where the starting point for the ions varies from (0,0) to (Δx,Δy), Δx and Δy being relatively small in regard of R.

Varying Δx only will just cause a simple translation Δx of the trajectory. The new centre of curvature having coordinates $(x_{\Delta x},y_{\Delta x})$ will be located at following coordinates:

$$x_{\Delta x}=1,05R+\Delta x, \text{ and}$$

$$y_{\Delta x}=0.$$

The ions are still crossing $S_1$, but their trajectories make at this point an angle $$\alpha = \frac{\Delta x}{R}$$

with the x axis.

Varying Δy only, modifies the interval d where $\vec{E}_1$ is acting, and of course the ions speed and the radius of curvature of the trajectories. We have:

$$\frac{R+\Delta R}{R} = \left(\frac{d-\Delta y}{d}\right)^{\frac{1}{2}} = \left(\frac{R-2\Delta y}{R}\right)^{\frac{1}{2}} \rightarrow \Delta R = -\Delta y$$

Accordingly the new centre of curvature having coordinates $(x_{\Delta y},y_{\Delta y})$ is located as follows:

$$x_{\Delta y}=1,05R-\Delta y \text{ and}$$

$$y_{\Delta y}=\Delta y.$$

The ions n are still crossing $S_1$ but at this level, the trajectories are making an angle $$\alpha = -\frac{\Delta y}{R}$$

with the x axis.

So if we take in account both a variation of Δx and Δy, the centre of curvature having coordinates $(x_{\Delta x\Delta y}, y_{\Delta x\Delta y})$ is located as follows:

$$x_{\Delta x\Delta y}=1,05R+\Delta x-\Delta y, \text{ and}$$

$$y_{\Delta x\Delta y}=\Delta y,$$

the radius of curvature being equal to R−Δy.

The trajectories at the level $S_1$ make an angle $$\alpha = \frac{\Delta x - \Delta y}{R}$$

with the x axis.

IMPORTANT PARTICULAR CASE: Δx=Δy and α=o.

This case corresponds to the ions created in the vicinity of a plane parallel to $\vec{B}_1$ intersecting the plane xy following a line x=y. All of these ions having the number of mass n, crossing $S_1$ for $$E_1 = \frac{2d\omega B_1}{n} = \frac{R\omega B_1}{n},$$

will have their trajectories at the level $S_1$ perfectly parallel to the x axis.

A setting allowing the creation of only these ions and so, to obtain at the exit $S_1$ a perfectly collimated beam, can be very simple.

Figure 2:
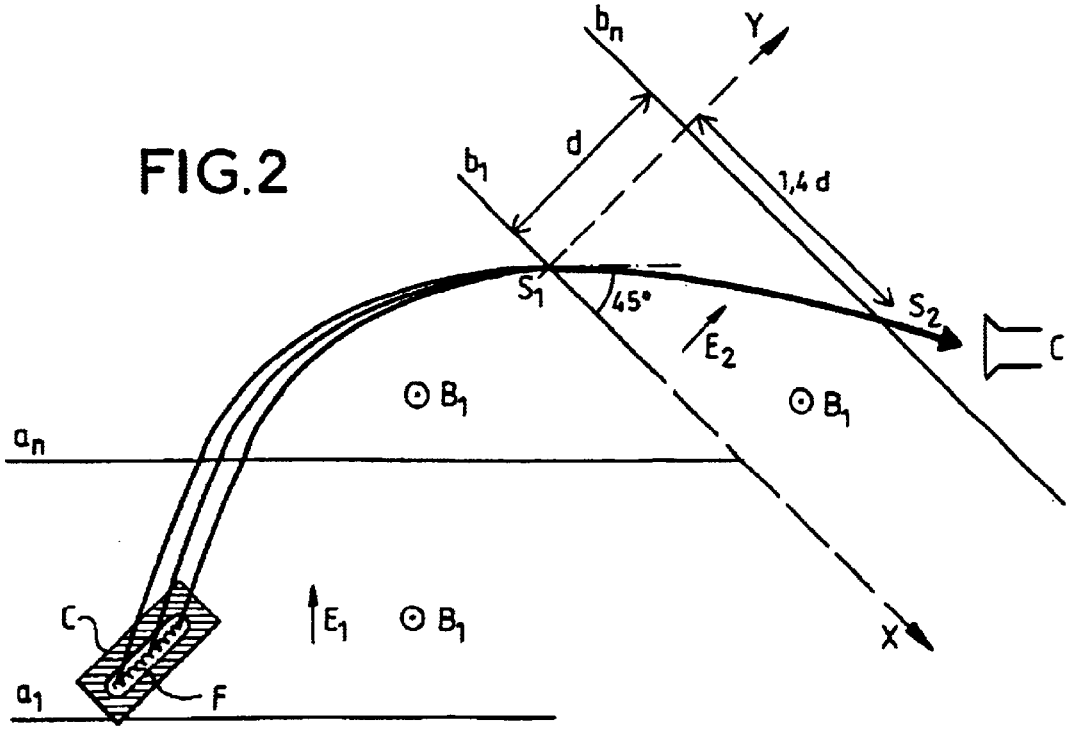

Referring to FIG. 2, a heated filament F, emitter of the ionising electrons, is stretched above the electrodes $\alpha_1$,α2, following a line x=y. The electron beam generated by the heated filament F is limited by a flat small electrode C, fitted with a narrow rectangular diaphragm, parallel to F and located between F and $\alpha_1,\alpha_2$.

We will now describe the introduction of the collimated ion beam in a "cycloid path" sector, where the ions will be submitted to the action of a second couple of crossed fields $\vec{E}_2,\vec{B}_1$.

The field $\vec{E}_2$ will be equal to $\vec{E}_1$ cos 45° and will make an angle of 45° with $\vec{E}_1$ and with the ion beam at $S_1$. We will use for this sector a second reference system X, Y in the same plane perpendicular to $\vec{B}_1$. The X- and Y-axis are respectively perpendicular and parallel to $\vec{E}_2$ and the origin is fixed at $S_1$.

$\vec{E}_2$ is established within a set of plane parallel electrodes $b_1, \ldots b_i \ldots, b_n$.

The initial speed v of the ions is given by:

$$v = \left(\frac{2eE_1d}{nm}\right)^{\frac{1}{2}} = \frac{R\omega}{n} = \frac{E_1}{B_1}$$

So, the components $X'_o$ and $Y'_o$ of v are given by $$X'_o = Y'_o = \frac{E_1}{B_1}\cos 45° = \frac{E_2}{B_1}.$$

Due to the different starting points of the ions in the source, these values are only an average but $\Delta X'_o$ is always equal to $\Delta Y'_o$.

The equations of the trajectories are, in general:

$$X = \frac{n}{\omega}Y'_o\left(1-\cos\frac{\omega t}{n}\right) - \frac{n}{\omega}\left(-X'_o + \frac{E_2}{B_1}\right)\sin\frac{\omega t}{n} + \frac{n}{\omega}\frac{E_2}{B_1}\frac{\omega t}{n}$$

$$Y = \frac{n}{\omega}Y'_o\left(\sin\frac{\omega t}{n}\right) + \frac{n}{\omega}\left(-X'_o + \frac{E_2}{B_1}\right)\left(1-\cos\frac{\omega t}{n}\right)$$

The conditions of unicity of the trajectories for small variations of $X'_o$ and $Y'_o$ are:

$$\frac{\frac{\delta Y}{\delta X'_o}}{\frac{\delta X}{\delta X'_o}} = \frac{\frac{\delta Y}{\delta Y'_o}}{\frac{\delta X}{\delta Y'_o}} = \frac{\frac{\delta Y}{\delta t}}{\frac{\delta X}{\delta t}}$$

It is easy to check that, for $$X'_o = Y'_o = \frac{E_2}{B_1}$$

and $\Delta X'_o = \Delta Y'_o$ these conditions are always fulfilled. All the ions n of the collimated beam at the exit of $S_1$ will follow exactly the same path, even when having different initial energies.

Of course, for the same value of $E_2$, the ions having a number of mass ≠n, i.e. having a value different from n, will follow different paths and be discarded.

We did not take in account the adverse effect of the random initial energy of the ions when created in the source. This energy, for "fragment ions" can be of the order of 1 eV.

The trajectories of those ions are not collimated at the exit $S_1$ but converge towards the ideal trajectory. Detailed computations show that they will cross it at a point of coordinates X≅1.5d and Y≅d.

In any case, it is well known that in a "cycloid path" mass spectrometer, the ions are perfectly focused, after a flying time $$t = \frac{2\pi n}{\omega},$$

on a line having, in our case, the coordinates X=8.9d and Y=O. This final decision slit $S_2$ is, of course, located there.

Figure 3:
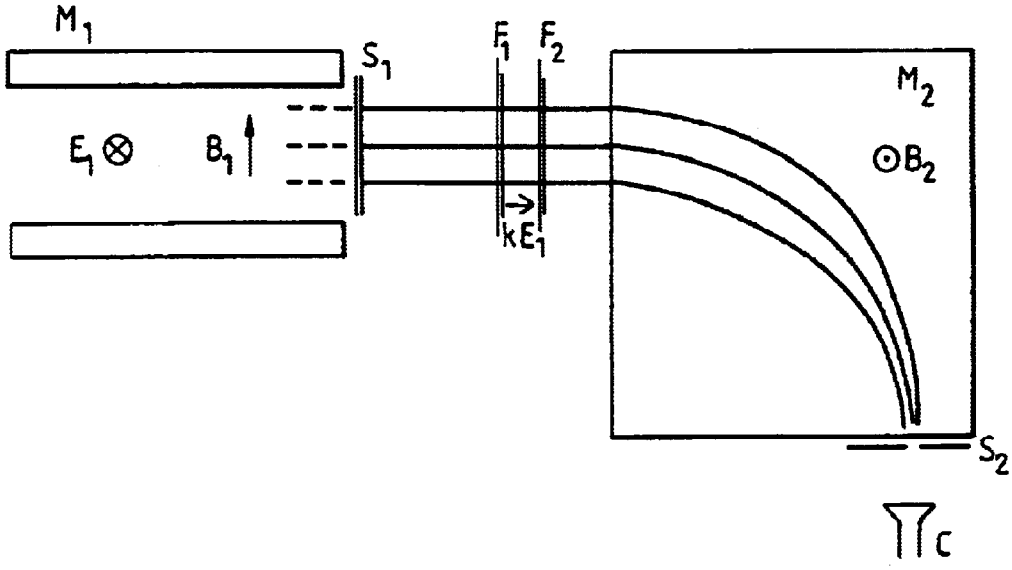

A different coupling can be done easily with a classical 90° magnetic sector. This is shown in the example illustrated in FIG. 3. The ion beam at the exit $S_1$ of the ion source has the geometry of a flat planar ribbon that can be introduced in the narrow gap of a magnetic circuit $M_2$.

Due to the small gap, the magnetic induction $\vec{B}_2$ can be much larger than $\vec{B}_1$ in the first magnetic circuit $M_1$. $\vec{B}_2$ is perpendicular to the plane of the ion beam and to $\vec{B}_1$, and so are the two magnetic circuits $M_1$, $M_2$.

In the gap of $M_2$, the ions n will follow circular trajectories having a radius $$R_2 = 2d\frac{B_1}{B_2}.$$

As $B_2 >> B_1$, $R_2$ is much smaller than $R_1$. In order to increase $R_2$ (and the resolution) it is easy to increase the ions energy with an accelerating electrical field $E_2 = kE_1$, between two electrodes $F_1$ and $F_2$ separated by a distance pd and located between the to magnetic circuits $M_1$,$M_2$. The initial energy of the ions having the mass number n when entering the gap in $M_2$ will be then equal to $$eE_1d(1+kp)$$

The radius of curvature $R_2$ of their paths will be, all computations done, $$R_2 = 2d\frac{B_1}{B_2}(1+kp)^{\frac{1}{2}}$$

A final selection hole $S_2$ is located at $X=Y=R_2$ where the ion beam section is reduced to a point.

Numerical Application

Let us choose $B_2=3B_1$ $R_2=R_1=2d$ p=0.5.

In this case the value of k is as follows: k=16. It is easy to check that, with these values, the aberrations at $S_2$ are negligible.

Behind $S_2$, a Faraday cup or an internal amplifier C (a channeltron for instance) will receive the selected ion beam. The sensibility is always limited by the grossly continuous noise of the amplifier. But, if the ion beam is modulated by a grid α, located for instance at $S_1$ and polarised at an alternative potential with a fixed frequency, the useful signal can be detected and amplified independently of the noise. The signal-to-noise ratio can be greatly improved. One skilled in the art would know how to modulate the grid potential for selective detection. Some examples are found in the Evrard '507 application.

CONCLUSION

This very simple system has both high sensitivity and high resolution.

The high sensitivity is mainly due to the fact that the ionisation volume is large and to the fact that the Open geometry of the system allows a complete extraction of the ions.

The high resolution is mainly due to the fact that the second selection sector is fed by a preselected collimated ion beam.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A mass spectrometer in which ions created by collision with an electron beam emitted by a heated filament, are submitted to the action of a uniform adjustable first electrical field $\vec{E}_1$, established within a set of plane parallel electrodes $a_1, \ldots, a_i, \ldots, a_n$, each plane parallel electrode being fitted with slits located for a transmission of the ions there through, and to the action of a uniform magnetic induction $\vec{B}_1$, the magnetic induction $\vec{B}_1$ being perpendicular to the first electrical field $\vec{E}_1$, the ions travelling in parallel travelling planes perpendicular to $\vec{B}_1$, each travelling plane having a reference system defined by an x-axis and an y-axis, the x-axis being perpendicular to the first electrical field $\vec{E}_1$ and the y-axis being parallel to the first electrical field $\vec{E}_1$, an origin of the reference system being located at an average intersection of the electron beam with the travelling plane, x and y both having the value 0 at the origin of the reference system, wherein for each travelling plane, the first electrical field $\vec{E}_1$ and the magnetic induction $\vec{B}_1$ act together on the ions in an area of the travelling plane where y<d, and the magnetic induction $\vec{B}_1$ acts alone on the ions in a further area of the travelling plane where y>d, d being a distance separating the origin of the reference system in the travelling plane from the electrode $a_n$, a first selection slit $S_1$ being located at coordinates x=2,1d and y=2d, and a value of the first electrical field $E_1$ that is applied for selecting ions having a number of mass n, being defined by, $$E_1 = \frac{2d}{n}\frac{e}{m}B_1^2, \quad \text{wherein } \frac{e}{m}$$

is a ratio charge to mass for a mono atomic hydrogen ion $H^+$, further wherein the ions are created by electronic bombardment only in the vicinity of a plane parallel to the magnetic induction $\vec{B}_1$, the plane parallel to the magnetic induction $\vec{B}_1$ having an angle of 45° with the first electrical field $\vec{E}_1$, the heated filament being positioned above the electrodes $a_1$,$a_2$, along a line in the plane parallel to the magnetic induction $\vec{B}_1$, the electron beam being limited by a rectangular diaphragm positioned parallel to the heated filament and between the heated filament and the electrodes $a_1$,$a_2$, such that a resulting collimated ion beam is substantially parallel to an x—axis of the travelling beam corresponding to the ion beam when crossing the first selection slit of the travelling plane, an ion beam intensity of the ion beam corresponding to a selected number of mass n for the ions.

2. A mass spectrometer according to claim 1, wherein after crossing the first selection slit, the ions are submitted to the action of a second electrical-field $\vec{E}_2$ and the magnetic induction $\vec{B}_1$, the second electrical field $\vec{E}_2$ being perpendicular to the magnetic induction $\vec{B}_1$, the second electrical field $\vec{E}_2$ being created within a second set of plane parallel electrodes $b_1, \ldots, b_i, \ldots b_n$ each plane parallel electrode being fitted with slits located for a transmission of the ions there through, the second electric field $\vec{E}_2$ being equal to $E_1$ cos 45° and the direction of the second electrical field $\vec{E}_2$ having an angle of 45° with the first electrical field $\vec{E}_1$, the ions travelling in parallel travelling planes perpendicular to $\vec{B}_1$, and for each travelling plane a second selection slit being located on a line defined susbstantially by X≅8,9d and Y=O in a further reference system of the travelling plane defined by an x-axis and an y-axis in the travelling plan, the x-axis being perpendicular to the first electrical field $\vec{E}_1$ and the y-axis being parallel to the second electrical field $\vec{E}_2$, an origin of the further reference system being fixed on the first selection slit.

3. A mass spectrometer according to claim 2, wherein the ion beam intensity is modulated by a grid located on the ions trajectory, and polarized with an alternating potential with a fixed frequency, the resulting modulated ion beam intensity being then amplified and detected independently of random background currents, unavoidable in any kind of mass spectrometer.

4. A mass spectrometer according to claim 1, wherein after the first selection slit, the ions are accelerated by an second electrical field $\vec{E}_2$, wherein a value of the second electrical field is defined as $E_2=kE_1$, the second electrical field being established between two grids $F_1$ and $F_2$ separated by a distance pd, the second electrical field $\vec{E}_2$ being perpendicular to the first electrical field $\vec{E}_1$, and after crossing the grid $F_2$ the ions are submitted only to the action of a second magnetic induction $\vec{B}_2$ the second magnetic induction $\vec{B}_2$ being perpendicular to the magnetic induction $\vec{B}_1$ and the second electrical field $\vec{E}_2$, the ions following circular paths in a plane perpendicular to the second magnetic induction $\vec{B}_2$, in which a reference system is defined by an x-axis parallel to the second electrical field $\vec{E}_2$ and an y-axis perpendicular to the second electrical field $\vec{E}_2$, an origin of the reference system being fixed on $F_2$, a selection diaphragm being located at a point having coordinates X and Y, wherein $X=Y=R_2$, $R_2$ being the radius of curvature for the trajectories corresponding to the number of mass n and being equal to $$2d\frac{B_1}{B_2}(1+kp)^{\frac{1}{2}},$$

with $E_1$ being equal to $$\frac{2d}{n}\frac{e}{m}B_1^2,$$

the factor k depending of the values chosen for $B_2$,$R_2$ and p.

5. A mass spectrometer according to claim 4, wherein the ion beam intensity is modulated by a grid located on the ions trajectory, and polarized with an alternating potential with a fixed frequency, the resulting modulated ion beam intensity being then amplified and detected independently of random background currents, unavoidable in any kind of mass spectrometer.

6. A mass spectrometer according to claim 1, wherein the ion beam intensity is modulated by a grid located on the ions trajectory, and polarized with an alternating potential with a fixed frequency, the resulting modulated ion beam intensity being then amplified and detected independently of random background currents, unavoidable in any kind of mass spectrometer.

* * * * *